US005549309A

United States Patent [19]

Gleichmann

[11] Patent Number: 5,549,309

[45] Date of Patent: Aug. 27, 1996

[54] MULTI-LINE IN-LINE ROLLER SKATE, MULTI-LINE IN-LINE ROLLER SKATE FRAME

[76] Inventor: Darin L. Gleichmann, 21752 Contado Rd., Boca Raton, Fla. 33433

[21] Appl. No.: 369,006

[22] Filed: Jan. 5, 1995

[51] Int. Cl.[6] ..... A63C 1/00

[52] U.S. Cl. ..... 280/7.1; 280/11.27; 280/11.22; 280/11.19

[58] Field of Search ..... 280/11.22, 11.27, 280/11.23, 11.19, 11.2, 7.1, 7.13, 7.14

[56] References Cited

U.S. PATENT DOCUMENTS

| | | | |
|---|---|---|---|
| 3,287,023 | 11/1966 | Ware | 280/11.2 |
| 3,880,441 | 4/1975 | Silver | 280/11.2 |
| 3,900,203 | 8/1975 | Kakalowicz | 280/11.22 |
| 4,618,158 | 10/1986 | Liberkowski | 280/11.2 |
| 4,659,095 | 4/1987 | Halvorsen | 280/11.27 |
| 4,909,523 | 3/1990 | Olson | 280/11.22 |
| 5,092,614 | 3/1992 | Malewicz | 280/11.22 |
| 5,183,276 | 2/1993 | Pratt | 280/11.22 |
| 5,232,231 | 4/1993 | Carlsmith | 280/11.22 X |
| 5,251,920 | 10/1993 | McHale | 280/11.19 |
| 5,295,701 | 3/1994 | Reiber et al. | 280/11.22 |
| 5,303,940 | 4/1994 | Brandner | 280/11.22 |
| 5,320,367 | 6/1994 | Landis | 280/11.22 |
| 5,382,031 | 1/1995 | Marconato et al. | 280/11.19 |
| 5,449,183 | 9/1995 | Klamer et al. | 280/11.27 |

*Primary Examiner*—Christopher P. Ellis
*Attorney, Agent, or Firm*—Alvin S. Blum

[57] ABSTRACT

A multi-line in-line roller skate, having a frame (15) which includes a pair of siderails (4), a center rail (3), and a topsurface (5), the frame composed of two adjacent siderails separated by either one or two center rails all of which are communicating with the topsurface through a common connection of their top edges. The siderails and center rail(s) are positioned so as to form two parallel channels or planes in which a plurality of wheels may supportably rotate therein. This combination of frame and wheels along with axles, bearings, aperture plugs, and an assortment of many other accessories can be put together and attached to a boot/shoe (6) to form the multi-line in-line roller skate (14). The frame (15) is made of a light-weight sturdy material which can withstand the random degrees of pressure that may be exerted upon it, and the design of the frame allows for many adjustments and varied wheel configurations . The frame may take many forms to facilitate utilization.

2 Claims, 2 Drawing Sheets

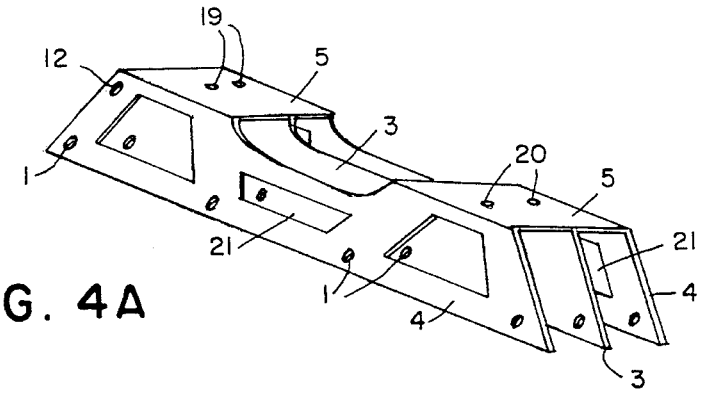
FIG. 4A
FIG. 4B
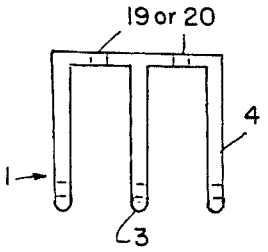
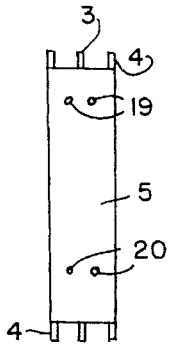
FIG. 4C
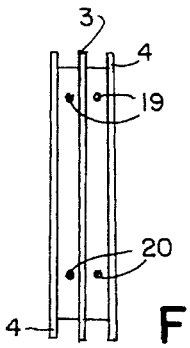
FIG. 4D
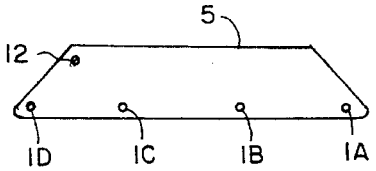
FIG. 4E
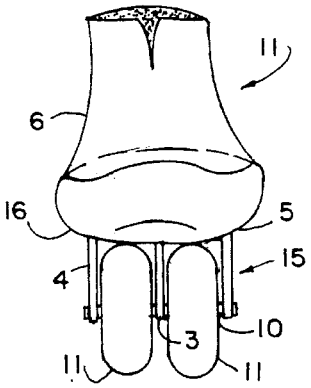
FIG. 2
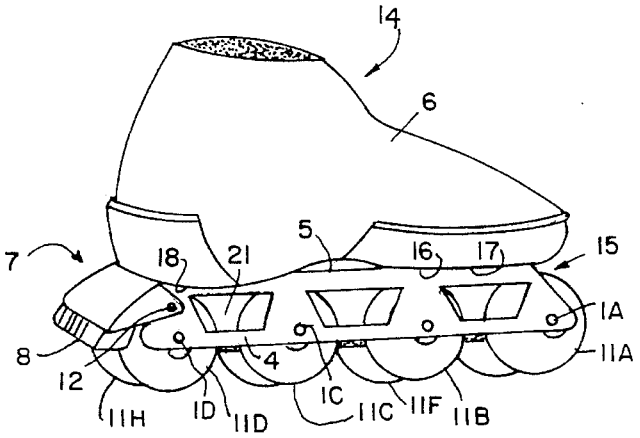
FIG. 1

FIG. 3B
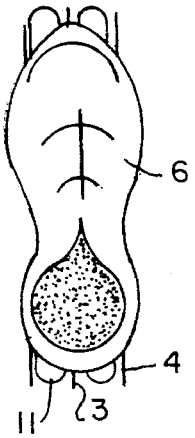
FIG. 3C
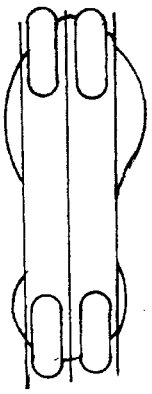
FIG. 3D
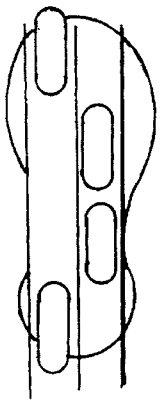
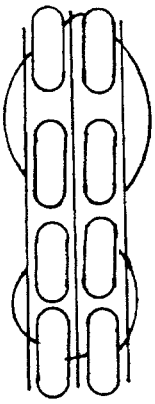
FIG. 3E
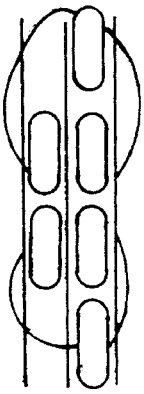
FIG. 3F
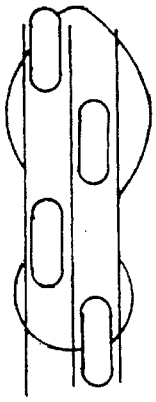
FIG. 3G
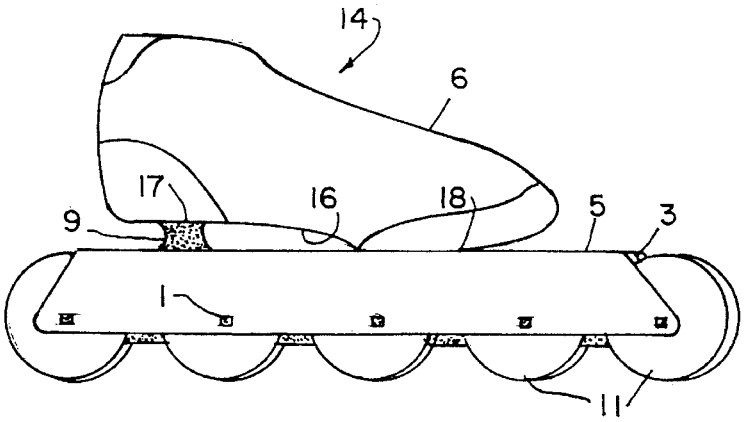
FIG. 3A

MULTI-LINE IN-LINE ROLLER SKATE, MULTI-LINE IN-LINE ROLLER SKATE FRAME

BACKGROUND-FIELD OF THE INVENTION

This invention relates to roller skates, generally to tandem or in-line roller skates, specifically to the roller skate frame and it's wheel configuration accommodations and extensibility.

BACKGROUND-DESCRIPTION OF PRIOR ART

Roller skates have changed in many ways since their early beginnings which, at the least was their introduction in 1876 in U.S. Pat. No. 7,345 of C. W. Saladee, which proposed a two wheel in-line model featuring a somewhat complicated, spring loaded frame supporting laterally pivoting rollers for maneuverability, but this apparatus was difficult to manufacture and assemble along with being quite heavy.

Other attempts to improve the tandem roller skate are shown in U.S. Pat. No's. 3,880,441, 3,900,203, 3,963,252, and 4,618,158. Other tandem roller skates with a multitude of various, distinct wheel configurations and wheel housing structures to better tandem roller skates and conventional roller skates and skating devices are viewable in U.S. Pat. No's. 189,783, 2,670,242, 4,054,335 and 4,114,952.

The major displeasures with these early devices was their inability to provide the user with maneuverability. As time progressed other factors added to the need to improve on the present devices of the time. The weight of the device was an obstruction that needed to be dealt with on a continual basis as the evolution of the roller skate progressed.

In 1946, U.S. Pat. No. 2,412,290 to O. G. Roeske disclosed a three-wheel, heavy metal framed in-line skate for indoor use which featured an endless rubberized belt to avoid damage to wooden floors. The belt rotated on three wheels in a pulley-like fashion, the intermediate wheel was vertically adjustable which produced a rocking action which enhanced maneuverability. Of course progress continued.

In 1966, G. K. Ware in U.S. Pat. No. 3,287,023 disclosed an in-line skate with thin rounded wheels His invention was established to simulate the much desired performance ability of ice skates. The Ware skate was composed of a moderately heavy metal frame, this frame resembles the advanced modified in-line frames of the late 1980's and early 1990's. The Ware frame and variations of it are still in use on currently available in-line roller skates and has been the best all around frame available for such skates, but the fact of the matter is the skate industry continues to progress, reason being the need for better performance. The basic idealogy behind the Ware skate came from early predecessors, and it's advancements can be seen as modifications of past inventions. Of course this holds true for most inventions.

Since the roller skating market is such a rapidly growing market, with attention being focused on providing a lighter, faster, more responsive skate that is easily and effectively manufactured, the broad array of skating devices available is constantly expanding. Tandem roller skates continue to get lighter, faster, and more responsive but they lack the speed and maneuverability of in-line roller skates. Literally, tandem roller skates can't keep up with the in-line skating market, not just functionally but also in consumer demand and need. In fact in-line roller skates have taken the roller skating market by storm. They have continually improved since their early beginnings and no doubt they will continue to do so. Since in-line skates utilize two or more wheels which are positioned to rotate in a common, vertical plane, they not only act to operate as roller skates but also have much of the similarities to-that of ice skates. It just so happens that the same bodily motions are required to operate all types of skates, them being ice, in-line, tandem and other such skates. This is one of the reasons for skatings increasing popularity. Not only do ice skaters benefit from their use in the off-season, but it is a training device for hockey players and figure skaters. The increasing popularity of skating has expanded the recreational aspect of the sport and it's health benefits parallel that of jogging, not to mention it's pleasurable, leisure aspects or merely it's answer to some users transportation capabilities. However it's put to use, Skating of all forms is now more popular than ever and this popularity will continue to grow as the skate market becomes more competitive and demanding than ever, and to help supply the demand of the market and to further progress the evolution of the roller skate to accommodate the needs of the user, the multi-Line In-Line skate is the answer.

With both tandem and in-line roller skates that are readily available today you would think the market to be flooded, but of course this is not so. The consumer is constantly searching for a better product. The introduction of roller skates back as early as 1876 got things rolling, but those early designs quickly became relics, they were heavy, slow and complicated. Further manipulation produced better faster tandem skates but the desire for speed and maneuverability far exceeded what was available at the time. This forced designers and inventors to procreate new designs. Tandem skates are still in use today by many users, some use tandem roller skates because of the stability they offer, other continue to use tandem skates because they are necessary for the task they perform. Still others continue to use tandem skates because they lack the want or the drive to try new product lines or they feel what is offered not better or suitable. The main benefit that tandem roller skates offer is stability and support, but in this day and age is it enough?

Apparently not, another factor which greatly effects the skate market is the ability to attain high speeds and control. Maneuverability is a feature which is a necessity and products that possess these two features have surpassed prior art not only in demand by the consumer but in efficiency. The in-line roller skate is such a product. It got an early start and is constantly being perfected, as is seen in B. J. Olson design U.S. Pat. No. 4,909,523. From his design many copies have been produced using basic concepts derived from his model and prior art, but with these styles of skating apparatus one can possess speed and maneuverability but there are consequences. Since the idea of in-lines was an off-shoot from the ice skate and the wheel configuration is similar to an ice skate in that it has a plurality of wheels rotating in a common plane a sacrifice must be made, that being of stability and support, which just so happens to be the advantages of the previous prior art or tandem roller skates.

In summary tandem roller skates provide stability and support to it's user but lack the speed and maneuverability that in-line roller skates possess, but to have speed and maneuverability in-line roller skates sacrifice support and stability. Why not combine the benefits of both so as to create a roller skate which possesses all of the above qualities and sacrifices little in doing so. Attempts to do so by design manipulation have been made, as seen in U.S. Pat. No. 5,183 276 of Kenneth W. Pratt, which in 1992 disclosed a tandem attached wheel which could be adjusted in location and was beneficial to the user if balance was ever lost. It's main function was added support only when stability was occasionally needed. This extra wheel was a precautionary mechanism. It's sole purpose was to act as a training device. Later in 1993 in U.S. Pat. No. 5,295,701 of Fredrick M. Reiber and Joseph P. Sejnowski also produced a in-line roller skate with an adjustable wheel configuration. The front and rear rollers were fixed and rotated in a common plane while the intermediate wheel was positionable either in the same common plane or in a adjacent plane. This also was solely for training purposes. Other attempts to produce a device which possessed speed, maneuverability, stability, and support really have not effectively or successfully solved the dilemma. In fact, all roller skating apparatus heretofore suffer from a number of disadvantages:

(a) Tandem roller skates lack the maneuverability and speed requirements which are so greatly in demand by today's market.

(b) In-line roller skates lack the support and stability requirements which are so greatly in demand by today's market.

(c) Tandem roller skates limit the user in competition which may require agility and high speeds.

(d) Tandem roller skates are not a suitable training tool for ice skaters, hockey players, skiers or ice figure skaters as the similarities and feel of the tandem roller skate does not coincide with their training needs.

(e) Due to the considerable amount of wheel-to-ground contact of tandem roller skates, maneuverability, agility and speed are all proportionally limited.

(f) In-line roller skates lack the support, stability and assurance of balance.

(g) In-line roller skate limit the user as age and physical ability are in some cases are a factor.

The present invention provides the benefits of both tandem and in-line roller skates while not sacrificing support, stability, speed or maneuverability by doing so. The present invention would be usable by a multitude of users for a vast array of uses, and at the same time would not be limiting to certain age groups or certain user's disabilities.

OBJECTS AND ADVANTAGES

Other than the objects and advantages of the multi-line in-line roller skate and multi-line in-line skate frame previously mentioned, several other objects and advantages of present invention are:

(a) to provide a roller skate which possesses the benefits of maneuverability, support, stability, and attainable variable speed;

(b) to provide a roller skate which is lightweight;

(c) to provide a roller skate which is durable;

(d) to provide a roller skate whose production is rapid and also economical;

(e) it is a principle object of the present invention to provide a roller skate with a sturdy light-weight frame for supporting a plurality of rotatable wheels in common planes;

(f) another object of the present invention is to provide a multi-line in-line roller skate having a frame which allows the user to facilitate a multitude of wheel configurations to suit each individuals needs;

(g) another object of the present invention is to provide any user with the choice of either acquiring the invention in already complete form or acquiring the new multi-line in-line frame and combining with boots, shoes, wheels and the many other accessories that are available in accordance with the invention;

(h) another object of the present invention is to provide a roller skate which combines the benefits of in-line and tandem roller skates into one apparatus;

(i) to provide a roller skate which is competitive in official, licensed sporting events as well as leisure activities;

(j) to provide a roller skate which is competitive with today's skate market yet does not limit it's consumer range based on user ability;

(k) to provide a roller skate which inflicts less fatigue on a user;

(l) to provide a roller skate which is substantially supportive;

(m) to provide a roller skate which mimics the feel and capabilities of in-line roller skates and ice skates yet does not require the user to pivot on a single point;

(n) to provide a roller skate that can be composed of a multitude of materials including plastic-like and metal-alloy materials;

(o) to provide a roller skate and roller skate frame that can be manufactured in a similar if not identical way as prior art is manufactured;

(p) to provide a roller skate which can endure and function upon a multitude of different riding surfaces;

(q) to provide a roller skate with a brake system that facilitates more skater-to-ground contact upon braking.

Other objects and advantages are to provide a new form of roller skate apparatus which is usable by a wider range of users who-may be for one reason or another limited to the use of a specific type of roller skating apparatus due to physical limitations or merely lack of choice. Also to provide a roller skating apparatus which can be adjusted to a user's particular likes, dislikes and handicaps through wheel adjustments and different wheel configurations. Still further objects and advantages will become apparent from a consideration of the ensuing description and drawings.

DRAWING FIGURES

In the drawings, closely related figures have the same number but different alphabetic suffixes.

FIG. 1 shows a perspective view of an multi-line in-line roller skate, illustrating the new frame in accordance with the new invention.

FIG. 2 shows a frontal view of the present invention, with the new frame attached thereto.

FIGS. 3A to 3G show various aspects of a multi-line in-line roller skate and new multi-line in-line frame, along with a variety of just a few of the many possible wheel configurations.

FIG. 4A shows just one of the many possible forms of the new multi-line in-line frame may assume, along with an example of accommodating top-surface and multitude of accessory apertures.

FIG. 4B shows a front view of the frame.

FIG. 4C shows a top view of the frame.

FIG. 4d shows a bottom view of the frame.

FIG. 4E shows a side view of the frame.

REFERENCE NUMERALS IN DRAWINGS

1 axle aperture

3 center rail

4 siderail
5 topsurface
6 boot/shoe
7 brake assembly
8 brake means
9 spacer (optional)
10 axle
11 wheel
12 aperture for brake attachment
14 multi-line in-line roller skate
15 frame(multi-line in-line)
16 sole of boot/shoe
17 front sole attachment means
18 rear sole attachment means
19 rear apertures
20 forward apertures
21 frame openings Description—FIGS. 1 to 4

A typical embodiment of the roller skate of the present invention is illustrated in FIG. 1 (perspective 3/4 rearview) and FIG. 2 (frontal view). The roller skate 14 has a frame 15 consisting of a lightweight, sturdy material which is manufactured and formed to facilitate the carrying of a plurality of wheels, as 11A or 11E as seen in FIG. 1. And said frame is also capable of carrying many wheels 11 either to rotate in a common plane with wheel 11A and or with wheel 11E, as seen in FIG. 1. In the preferred embodiment, the frame 15 is a rigid metal-alloy or plastic-like lightweight strong material which is either manufactured or extruded and can withstand the pressures it must undergo during use by various users under various conditions and upon various riding surfaces. The frame 15 which embodies the present invention as seen in FIG. 4A possesses a multitude of apertures for placement of many accessories. Apertures 1A to 1H allows for passage of axles through and from siderail 4 through center rail 3 to and through the opposite adjacent siderail of the present invention as seen in FIG. 1. Said axles facilitate and support the attachment and rotation of wheels 11A to 11H as shown in FIG. 1. Said frame in FIG. 4A also possesses aperture 12 which is continuous from siderail through center rail to siderail and permits the attachment of a brake assembly. In FIG. 4A apertures designated 19 and 20 allow for forward and rearward attachment means for boot/shoe 6 as seen in FIG. 1.

Referring now solely to FIG. 1 which illustrates an multi-line in-line roller skate 14 embodying the invention includes a frame 15 to which a plurality of similar identical in-line roller skate wheels 11A to 11H are rotatably mounted. The frame carries along with it a brake assembly 7 at the rear thereof and the whole combination of frame, brake assembly, wheels, bearings etc . . . is mounted to a boot/shoe which provides support, protection and a means of attaching user to apparatus. While the boot/shoe 6 provides one type of attachment means for releasably securing the frame 15 to a skater, it should be understood that other boots, shoes, clamps and fasteners can be substituted. And as the boot/shoe can be interchangeable so can the wheels and bearing systems be interchanged and varied with the accessories available in today's skate market.

Frame 15 is illustrated in FIGS. 4A to 4E, which includes a topsurface 5 which maybe a continual or intermittent surface. The topsurface's may also be level or bileveled to allow for direct attachment to a boot or shoe with or without the use of a spacer. Frame 15 includes siderails 4 and a center rail 3 along with topsurface 5 which compose the major components of the present invention's new frame. This frame provides two channels which are parallel and adjacent to one another for which to allow the rotation of a plurality of wheels in two adjacent parallel planes which are side by side to allow support to the user while promoting the in-line feel. The multitude of apertures that the frame possesses for axle placement can be engineered to facilitate the use of the wide variety of wheel-bearing combinations as well as allow for many different wheel configurations, wheel heights and adjustments. For example, the apertures may be off-set to allow for a staggering of the wheel placement, but of course this is merely one example. The apertures of the frame may also be engineered to accept the placement of aperture plugs which allows a means of isolating the wheels, axles, and bearings so that they function as intended. Said aperture plugs also function to promote various wheel height adjustment capabilities. In short, many adjustments are possible and each user is free to choose which orientations best suits their needs. As seen in FIGS. 3F and 3G which are just two of the many possible wheel orientations which can be utilized and should no way limit the scope of this invention. The frame and multi-line in-line roller skate possess the ability to accommodate the needs of the many users in the skate market.

FIG. 3A shows another illustration of the present invention in which the frame assumes another form, but this should not be construed as limiting the scope of the present invention, but merely further prove the versatility of the present invention and illustrate just a few of the presently preferred embodiments of this invention in it's entirety, and although this invention's description contains many specificities, these specificities should also not limit the scope of the present invention.

From the description above of the illustrated figures a number of advantages of my multi-line in-line roller skate become evident:

(a) A multi-line in-line roller skate allow for more user to skating surface contact, which provides support and stability.

(b) With more stability and less demand on the user's ability to balance, a muti-line in-line roller skate will provide an apparatus which causes less fatigue on it's user.

(c) With the use of the multi-line in-line roller skate, one can adjust wheel configurations and wheel heights to accommodate to needs of each particular user.

(d) The benefits of tandem roller skates and in-line roller skates are incorporated into one apparatus.

(e) The one time, once limiting factors of in-line roller skates and tandem roller skates are no longer due to the incorporation of all the beneficial aspects of both into the present invention.

Operation—FIG. 1

The manner of using the multi-line in-line roller skate is similar if not identical to that for all types of skating devices in today's skating market be either roller skating, ice skating, and in-line skating. The bodily movements required to use the present invention mimics the same body movements to use all other types of skates that are present today. Basically, it encompasses merely attaching the present invention to a user, and skate away.

Summary, Ramification, and Scope

Accordingly, the reader will see that the roller skate of this invention provides the user with a roller skating device which is unparalleled (pardon the pun) by any other on the market. The multi-line in-line roller skate of this invention can be used; as a training device, a device for leisure activities, a device that promotes a healthier lifestyle, a device which can be used by a variety of users who at one time for one reason or another could not use such a device. This invention provides the user with all the benefits of tandem and in-line roller skates into one apparatus. Furthermore, the multi-line in-line roller skate frame has additional advantages in that

- it allows the user to skate with added balance and stability not offered by in-line roller skates;
- it permits the user to skate with an enhanced ability to attain a broader range of varied speeds while maintaining an in-line advantage of maneuverability and a tandem wheel arrangement advantage of balance and support;
- it permits use with lessened amounts of fatigue which is usually acquired through the use of prior art either because of balance requirements or user/device-to-ground contact friction;
- it is easily manufactured to accommodate the advanced wheel-bearings-axle systems that are available in today's skate market;
- it permits multiple wheel configurations and wheel height adjustments to accommodate to the user's many needs;
- it aides in providing and promoting a highly competitive roller skating device in the skating market;
- it provides a roller skating means which can be used by a broad spectrum of users and is less discriminating in regards to physical abilities of it's users;
- it provides a means for training for certain activities in an off-season environment;
- it provides for a roller skating means which can be utilized for leisure, health, sport, or recreational use.

Although the above description contains specific benefits, specificities and uses, these should not be viewed as a way to limit the scope of the invention and by viewing the provided illustrations it should be acknowledged that these are but a mere few examples of the broad spectrum of abilities this invention possesses. The given examples, specificities and illustrations are just a few of the presently preferred embodiments of this invention. There are many more possible variations and forms the present invention could be utilized as. For example, the frame can be elongated or shortened to facilitate the housing of two or three wheels per parallel plane or hold five or more wheels per parallel plane. Wheels can either be added for stability or removed for weight consideration. The frame can be engineered to take on many forms to facilitate the attachment to various boots and shoes and the frame may also be constructed in different forms to further strengthen, lighten etc . . .

Thus the scope of the invention should be determined by the appended claims and their legal equivalents, rather than by the examples given.

I claim:

1. A dual line in-line roller skate comprising:

a shoe having an outer sole surface, a toe and a heel;

a skate frame having a top member attached to said outer sole surface;

an elongate center rail rigidly attached to said top member and extending downward therefrom;

two elongate side rails rigidly attached to said top member and extending downward therefrom;

said side rails arranged one on either side of, and parallel to, said center rail, with all three of said rails having long axes in a toe to heel direction and cooperating to form elongate parallel first and second channels for supporting wheels therein;

a plurality of axles;

a plurality of wheels rotatably supported on said axles;

a plurality of apertures in all three of said rails lying transverse to said long axes, said apertures adapted to be selectively used to support said axles in said channels as desired for arranging diverse wheel configurations in which all of the wheels in said first channel lie in a common first vertical plane and all of the wheels in said second channel lie in a common second vertical plane parallel to said first vertical plane;

said axles being readily positionable in selected said apertures such that spacing apart of the wheels within one of said channels may be adjusted and the wheels in the adjacent channel may be positioned adjacent one another or non-adjacent as desired.

2. A skate frame for attachment to a shoe having a sole, a heel and a toe, the skate frame comprising:

a rigid top member adapted for attachment to a shoe sole;

an elongate center rail rigidly attached to Said top member and extending downward therefrom;

two elongate side rails rigidly attached to said top member and extending downward therefrom;

said side rails arranged one on either side of, and parallel to, said center rail, with all three of said rails having long axes in a toe to heel direction and cooperating to form elongate parallel first and second channels for supporting wheels therein;

a plurality of axles;

a plurality of wheels rotatably supported on said axles;

a plurality of apertures in all three of said rails lying transverse to said long axes, said apertures adapted to be selectively used to support said axles in said channels as desired for arranging diverse wheel configurations in which all of the wheels in said first channel lie in a common first vertical plane and all of the wheels in said second channel lie in a common second vertical plane parallel to said first vertical plane;

said axles being readily positionable in selected said apertures such that spacing apart of the wheels within one of said channels may be adjusted and the wheels in the adjacent channel may be positioned adjacent one another or non-adjacent as desired.

* * * * *